US007797837B2

(12) United States Patent
Wu

(10) Patent No.: US 7,797,837 B2
(45) Date of Patent: Sep. 21, 2010

(54) CARPENTER KNIFE WITH LOCKING MEANS

(76) Inventor: Yuewei Wu, Ningbo Xingwei Plastic Product Co., Ltd., Inustrial Zone of Xidian, Ninghai,, Zhejiang Province (CN) 315613

( * ) Notice: Subject to any disclaimer, the term of this patent is extended or adjusted under 35 U.S.C. 154(b) by 35 days.

(21) Appl. No.: 12/007,613

(22) Filed: Jan. 14, 2008

(65) Prior Publication Data

US 2009/0178283 A1 Jul. 16, 2009

(51) Int. Cl.
*B26B 1/08* (2006.01)

(52) U.S. Cl. ..... 30/162; 30/335

(58) Field of Classification Search ..... 30/162, 30/335

See application file for complete search history.

(56) References Cited

U.S. PATENT DOCUMENTS 4,089,112 A * 5/1978 Richards ..... 30/162
4,858,320 A * 8/1989 Lemaire ..... 30/162
5,386,632 A * 2/1995 Schmidt ..... 30/125
6,349,473 B1 * 2/2002 Schmidt ..... 30/162
6,907,668 B2 * 6/2005 Polei ..... 30/162
2003/0024123 A1 * 2/2003 Liao ..... 30/162
2007/0245569 A1 * 10/2007 Yu Chen ..... 30/143
2009/0094840 A1 * 4/2009 Kanemoto et al. ..... 30/162

* cited by examiner

*Primary Examiner*—Hwei-siu C Payer

(57) ABSTRACT

A carpenter knife with locking member having a handle having a left shell and a right shell coupled together, a slit defined in the left shell, a stage formed rounding the slit; a knob being roughly of oval shape and having a central opening; a blade having a cutting edge and contained in and slidable with respect to the handle, an installing notch defined in the blade on a side opposite to the cutting edge; a blade seat contained in the handle, the blade seat having a bottom plate, two side walls, a spring tongue, and at least one installing protrusion, a top protrusion and a side protrusion formed on a free end of the spring tongue; and, a pin passing through the central opening of the knob and having a hole in which the top protrusion being firmly inserted in.

3 Claims, 3 Drawing Sheets

CARPENTER KNIFE WITH LOCKING MEANS

BACKGROUND OF THE INVENTION

1. Field of the Invention

The invention relates to a carpenter knife with locking means, and more particularly, to a carpenter knife a blade of which is able to be securely locked and replaced by simple operation.

2. Description of the Prior Art

Since in cutting, a blade of a carpenter knife may retract into a cover, which is also a handle of the carpenter knife, a carpenter knives with locking means to fix the blade have long been developed. Conventional such carpenter knives usually realize the locking with friction force between the blade and a locking means. However, such locking means is not reliable enough since the blade might still retract when a force exerting on the blade is great.

BRIEF SUMMARY OF THE INVENTION

The main object of the invention is to provide a carpenter knife with locking means a blade thereof is able to be securely locked.

Another object of the invention is to provide a carpenter knife with locking means the blade thereof is able to be replaced by a simple operation.

In accordance with one aspect of the invention, there is provided a carpenter knife with locking means having a handle having a left shell and a right shell coupled together, a slit defined in the left shell, a stage formed rounding the slit; a knob being roughly of oval shape and having a central opening; a blade having a cutting edge and contained in the handle, an installing notch defined in the blade on a side opposite to the cutting edge; a blade seat contained in the handle, the blade seat having bottom plate, two side walls, a spring tongue, and at least one installing protrusion, a top protrusion and a side protrusion formed on a free end of the spring tongue; and, a pin passing through the central opening of the knob and having a hole in which the top protrusion being firmly inserted in.

These and other objectives, features, and advantages of the present invention will become apparent from the following detailed description, the accompanying drawings, and the appended claims.

DETAILED DESCRIPTION OF THE PREFERRED EMBODIMENT

Figure 1:
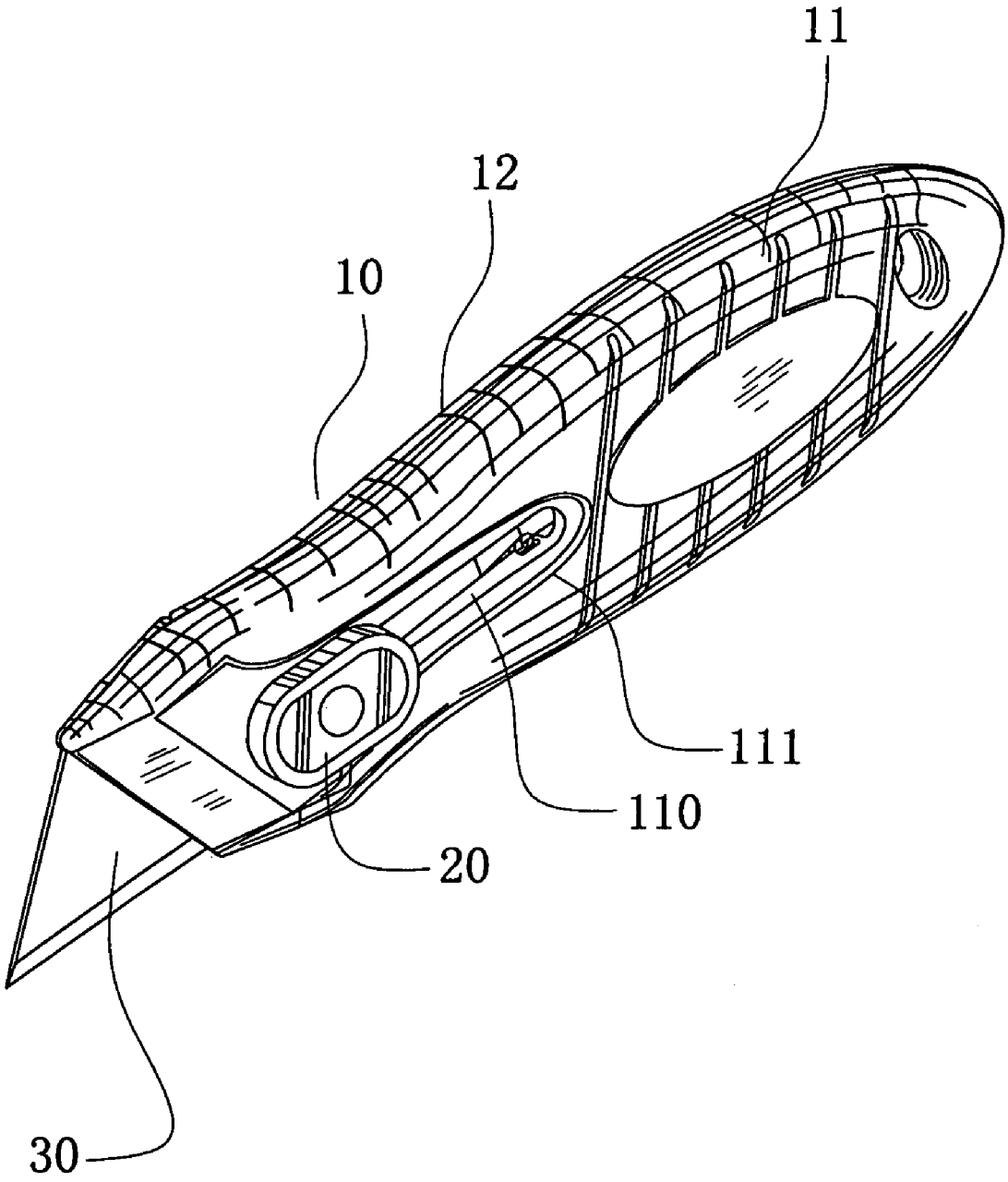
FIG. 1 is a perspective view of the preferred embodiment of the carpenter knife.

With reference to FIG. 1, the preferred embodiment of the carpenter knife with locking means is shown. The carpenter knife has a handle 10, which consists of a left shell 11 and a right shell 12 coupled together. A slit 110 is defined in the left shell 11 along which a knob 20 is able to slide. The knob 20 is roughly of oval shape. A blade 30 is contained in and slidable with respect to the handle 10. A stage 111 is formed rounding the slit 110.

Figure 2:
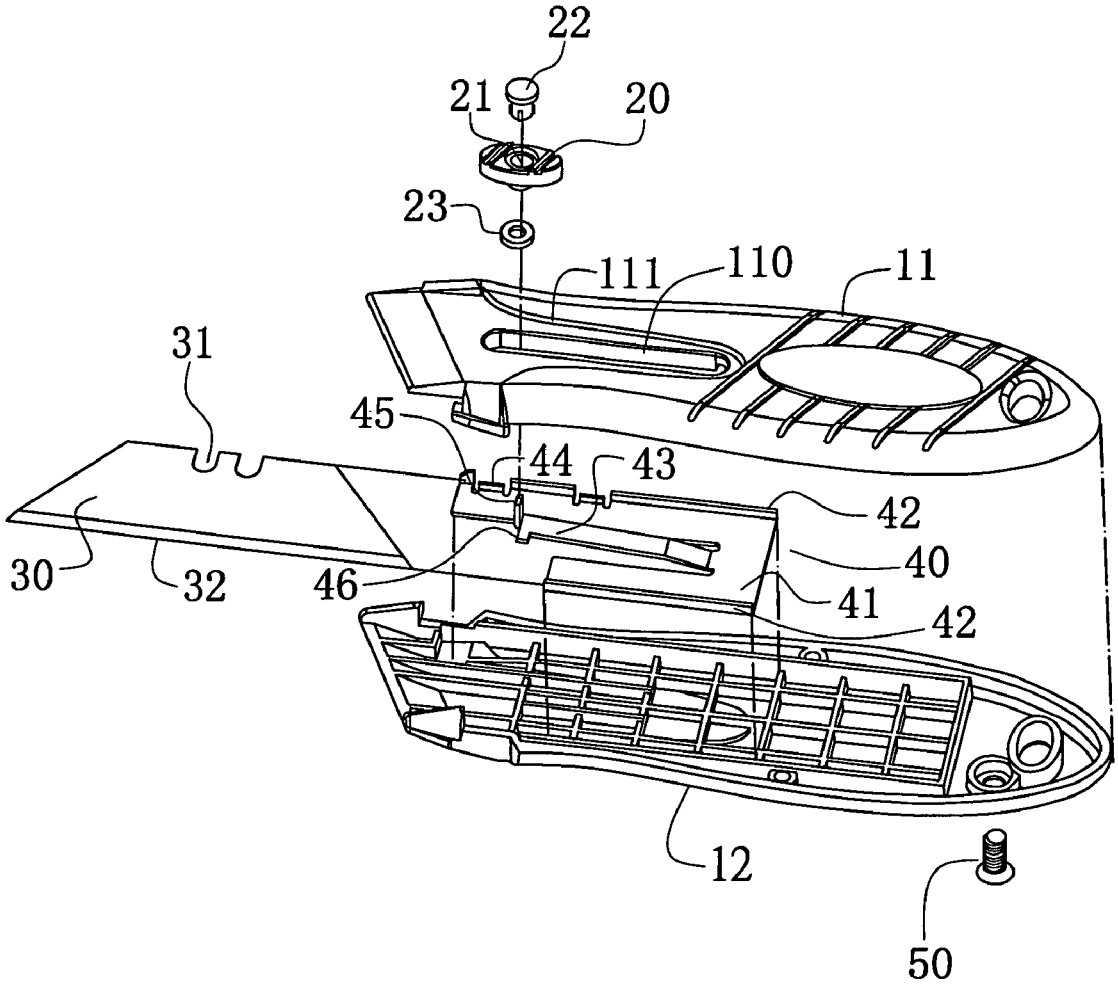
FIG. 2 is an exploded view of the carpenter knife shown in FIG. 1.

As shown in FIG. 2, a blade seat 40 is contained in the handle 10. The blade seat 40 is of a shape of rectangular and has a bottom plate 41, two side walls 42, a central spring tongue 43, and at least one installing protrusion 44. An installing notch 31 is defined in the blade 30 on a side opposite to a cutting edge 32. The blade 30 is installed in the blade seat 40 between the bottom plate 41 and the spring tongue 43, with the installing protrusion 44 being received in the installing notch 31. A top protrusion 45 and a side protrusion 46 are formed on a free end of the spring tongue 43. The knob 20 has a central opening 21, through which a pin 22 passes. The pin 22 fixes the knob 20 onto the blade seat 40 with the top protrusion 45 being firmly inserted into a hole defined therein. A washer 23 may be provided between the knob 20 and the left shell 11. The left shell 11 and the right shell 12 are able to be coupled together by one or more screws 50.

Figure 3:
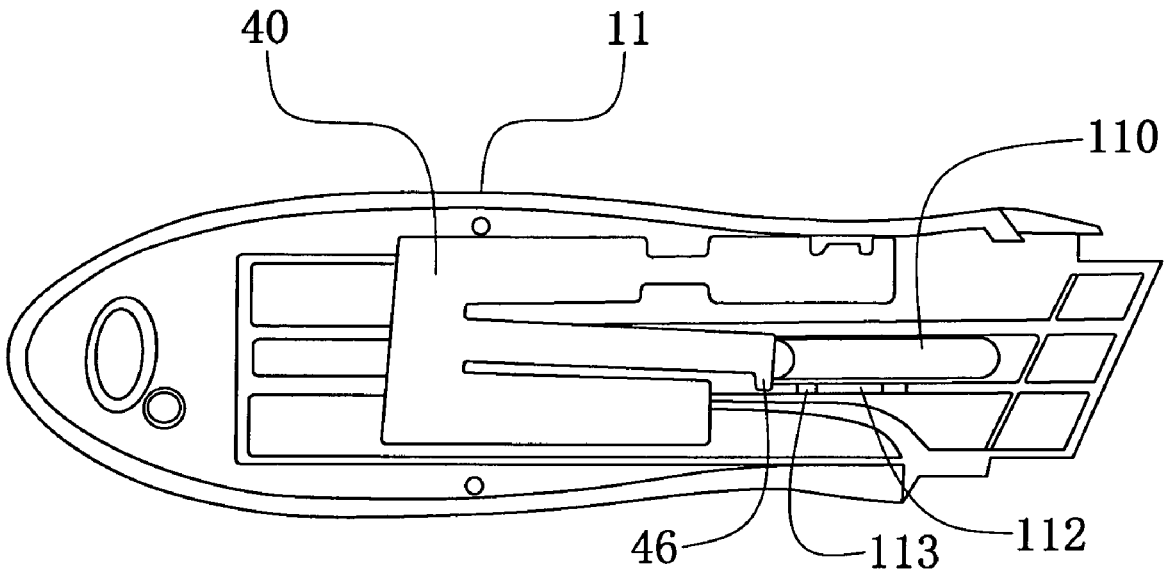
FIG. 3 is a side view of a left shell of the carpenter knife shown in FIG. 1.

With reference to FIG. 3, it is a side view of the left shell 11 of the carpenter knife shown in FIGS. 1 and 2. A side beam 112 is formed along the slit 110. A plurality of evenly spacing locking notches 113 are defined in the side beam 112.

In use, a user is able to rotate the knob 20 making a major axis thereof parallel to the slit 110, as shown in FIG. 1. Then the user may push the knob 20 to slide the blade 30 along the handle 10. When the user needs to lock the blade 30 with respect to the handle 10, either when the blade 30 is totally retracted into or moved out from the handle 10, the user is able to rotate the knob 20 about 90 degrees until the major axis thereof roughly perpendicular to the slit 110. The knob 20 then meets the stage 111 and pushed by the stage 111 to move in a direction apart from the left shell 11. The side protrusion 46, fixed to the knob 20 by the pin 22, will enter into one of the plurality of the locking notches 113. The blade seat 40 will not be able to move with respect to the handle 10 and the blade 30 installed on the blade seat 40 is locked accordingly. If the user rotates the knob 20 again to a parallel position, the spring tongue 43 moves back and pull the knob 20 backward. The side protrusion 46 leaves the locking notch 113 and the blade seat 40 will be able to slide with respect to the handle 10 again.

When the blade 30 needs to be replaced, the user is able to push the knob 20 to a front most position and the blade 30 is able to be taken off from the installing protrusion 44. A new blade 30 then will be able to be installed onto the installing protrusion 44.

From above description, it could be seen that the blade of the carpenter knife is able to be securely locked and replaced by a simple operation.

One who is skilled in the art will understand that the aforementioned embodiment of the invention as shown in the drawings and described above is for example only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A carpenter knife with locking means comprising:

a handle having a left shell and a right shell coupled together, a slit defined in said left shell, a stage formed rounding said slit;

a knob being roughly of oval shape and having a central opening;

a blade having a cutting edge and contained in said handle, an installing notch defined in said blade on a side opposite to said cutting edge;

a blade seat contained in said handle, said blade seat having a bottom plate, two side walls, a spring tongue, and at least one installing protrusion, a top protrusion and a side protrusion formed on a free end of said spring tongue; and, a pin passing through said central opening of said knob and having a hole in which said top protrusion being firmly inserted in.

2. The carpenter knife with locking means as claimed in claim 1, wherein a washer is provided between said knob and said left shell.

3. The carpenter knife with locking means as claimed in claim 1, wherein said left shell and said right shell are coupled together with at least one screw.

* * * * *